United States Patent [19]

Heine

[11] Patent Number: 5,060,716

[45] Date of Patent: Oct. 29, 1991

[54] HEAT DISSIPATING DEVICE AND COMBINATION INCLUDING SAME

[76] Inventor: William F. Heine, 325 Grissom Rd., Manchester, Conn. 06040

[21] Appl. No.: 331,356

[22] Filed: Mar. 31, 1989

[51] Int. Cl.[5] ..... F28F 5/00; B01D 24/00; B01D 29/00; B01D 35/18

[52] U.S. Cl. ..... 165/47; 165/119; 165/183; 165/185; 165/80.1; 165/86; 210/186; 269/254 CS; 269/287; 24/567

[58] Field of Search ..... 165/47, 119, 181, 185, 165/901, 80.1, 80.2, 80.3, 80.4, 80.5, 81, 86, 183, 184; 123/41.33, 196 AB; 210/184, 186; 269/254 CS, 287; 24/567

[56] References Cited

U.S. PATENT DOCUMENTS

| | | | |
|---|---|---|---|
| 1,764,278 | 6/1930 | Olby | 24/567 |
| 2,673,721 | 3/1954 | Dickinson | 165/80.3 |
| 2,798,695 | 7/1957 | Arleque | 165/80.1 |
| 2,879,041 | 3/1959 | Ross | 165/80.3 |
| 3,002,729 | 10/1961 | Welsh | 165/183 |
| 3,091,736 | 5/1963 | Germain | 165/80.3 |
| 3,280,907 | 10/1966 | Hoffman | 165/80.3 |
| 3,284,664 | 11/1966 | Morin et al. | 165/80.3 |
| 3,656,547 | 4/1972 | Beach | 165/183 |
| 3,774,681 | 11/1973 | Wirtanen | 165/184 |
| 3,819,194 | 6/1974 | Grevich et al. | 269/254 CS |
| 4,211,208 | 7/1980 | Lindner | 165/46 |
| 4,236,578 | 12/1980 | Kreith et al. | 165/185 |
| 4,244,098 | 1/1981 | Barcus | 165/80.3 |
| 4,390,060 | 6/1983 | Reinke et al. | 165/901 |
| 4,442,819 | 4/1984 | Veach | 210/186 |
| 4,457,360 | 7/1984 | Roose | 165/80.3 |

FOREIGN PATENT DOCUMENTS

| | | | |
|---|---|---|---|
| 546836 | 3/1932 | Fed. Rep. of Germany | 165/183 |
| 38249 | 4/1931 | France | 165/183 |
| 1096483 | 6/1984 | U.S.S.R. | 165/183 |
| 11278 | of 1914 | United Kingdom | 165/185 |
| 329758 | 5/1930 | United Kingdom | 165/185 |

*Primary Examiner*—John Ford
*Attorney, Agent, or Firm*—CTC & Associates

[57] ABSTRACT

A device for dissipating heat from a cylindrical object includes a heat dissipating element of thermally conductive material and at least a first spring for releasably and resiliently holding the heat dissipating element against the exterior of the object, in particular an automotive oil filter. In the disclosed examples, there are a plurality of like elongated heat dissipating elements each of which has a hole therethrough, and the spring is a coil spring which passes through the holes and its ends are fastened to each other. Each heat dissipating element has an inner flange providing the element with an inner face for fitting against the cylindrical object and a central portion projecting outwardly from a central location relative to the inner flange, and the spring-containing holes are located in the central portions of the heat dissipating elements. In one example, each heat dissipating element has substantially the shape of a T-bar and in another example, each heat dissipating element has substantially the shape of an I-beam. In combination with the object, the inner faces of the heat dissipating elements fit against the cylindrical object with the spring or springs under resilient tension and surrounding the cylindrical object.

10 Claims, 1 Drawing Sheet

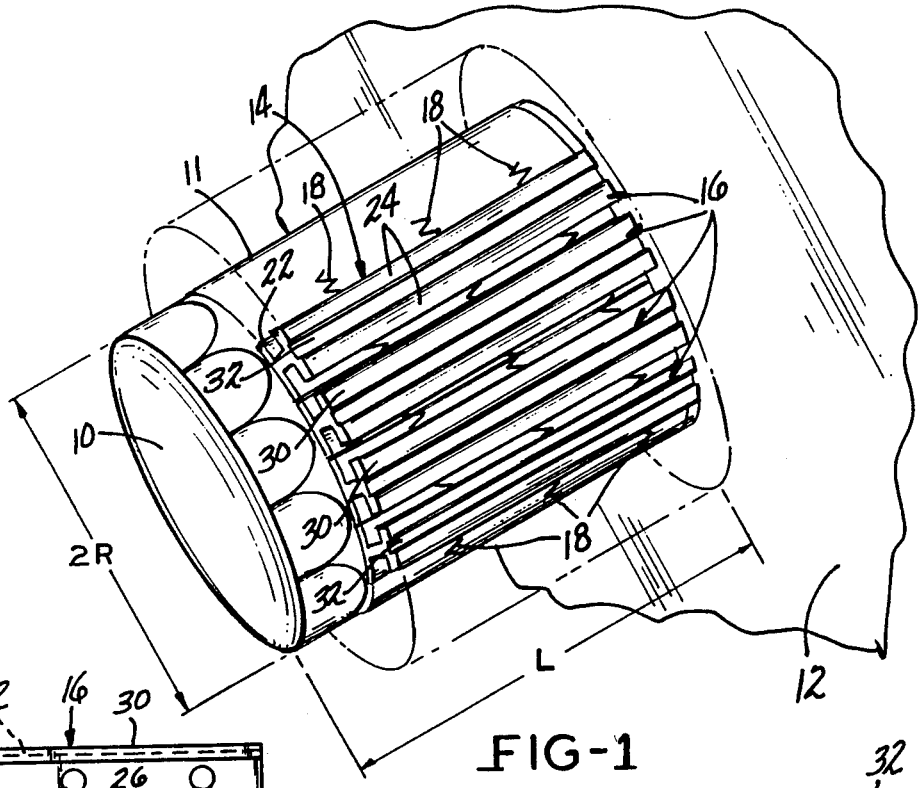
FIG-1
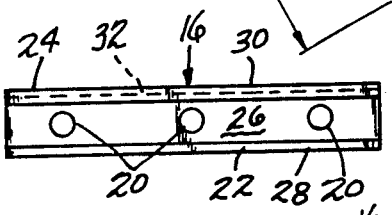
FIG-3
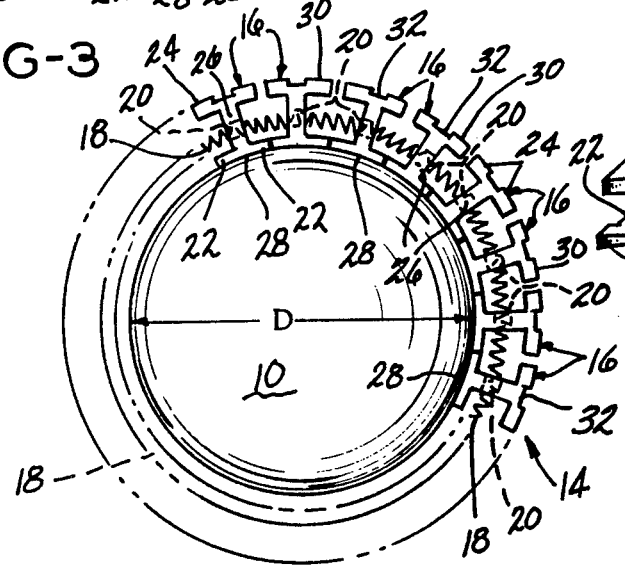
FIG-2
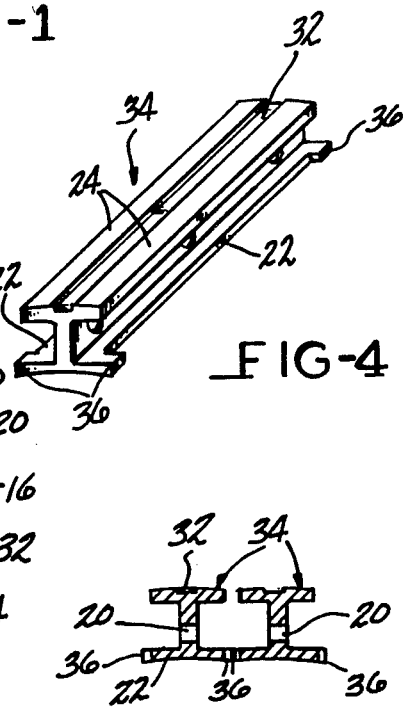
FIG-4
FIG-5
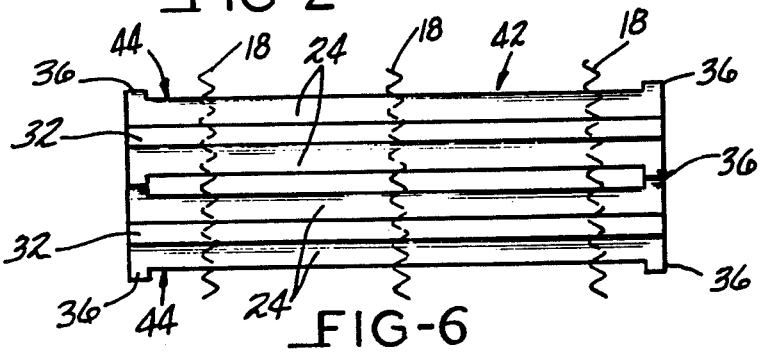
FIG-6
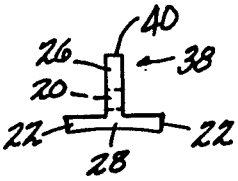
FIG-7

HEAT DISSIPATING DEVICE AND COMBINATION INCLUDING SAME

BACKGROUND OF THE INVENTION

This invention relates to heat dissipating devices and more particularly to such a device for use with a cylindrical object, for example an oil filter that is installed on an engine block, such as in an automobile. The invention also relates to combinations including such a heat dissipating device.

Except where further limited, the word "cylindrical" is used herein in the sense of a convex surface bounded by two parallel planes and generated by a line tracing a closed curve perpendicular to the parallel planes.

The invention will be described hereinafter as related to an oil filter, but this is without limitation, since the invention may also be used to dissipate heat from other items.

It is well known that oil filters attain very high temperatures when their associated engines are operated, and also that performance of oil filters would be enhanced if their operating temperatures were reduced.

The invention enables that result to be attained, with a heat dissipating device that is extremely simple in construction, low in cost, easily applied, easily removed, and that is of long useful life and that is reusable.

Important objects of the invention are to provide a heat dissipating device that attains the above advantages.

The manner in which the above enumerated advantages and objects are attained will appear hereinafter.

SUMMARY OF THE INVENTION

The invention contemplates a device for dissipating heat from a cylindrical object. The device includes a heat dissipating element of thermally conductive material and at least one spring, and preferably a plurality of springs for releasably and resiliently holding the heat dissipating element in assembled relationship and against the exterior of the cylindrical object. In the disclosed examples, there are a plurality of like elongated heat dissipating elements each of which has a hole therethrough and each spring is a coil spring which passes through the holes and the ends of each coil spring are fastened to each other. Each heat dissipating element has an inner flange providing the element with an inner face for fitting against the cylindrical object and a central portion projecting outwardly from a central location relative to the inner flange, and the spring-containing holes are located in the central portions of the heat dissipating elements. In one example, each heat dissipating element has substantially the shape of a T-bar and in another example, each element has substantially the shape of an I-beam.

In combination with the object, the inner faces of the heat dissipating elements fit against the cylindrical object with the spring under resilient tension and surrounding the cylindrical object.

DESCRIPTION OF THE DRAWING

FIG. 1 is a partly schematic perspective view of an assembly of a heat dissipating device that is a preferred embodiment of the invention and an oil filter installed on an engine block, the heat dissipating device including a plurality of heat dissipating elements of a first form;

FIG. 2 is an end view of the assembly of the heat dissipating device and the oil filter as seen from the lefthand end of FIG. 1;

FIG. 3 is a side elevation of one of the heat dissipating elements of the first form;

FIG. 4 is a perspective view of a heat dissipating element of a second form;

FIG. 5 is a transverse sectional view of a pair of heat dissipating elements of the second form;

FIG. 6 is a fragmentary plan view of a heat dissipating device showing a pair of abutting heat dissipating elements of the second form and springs holding the elements in assembled relationship; and FIG. 7 is an end view of a heat dissipating element of a third form.

DESCRIPTION OF THE INVENTION

FIGS. 1 and 2 show an object that will be assumed without limitation to be an automobile oil filter 10 having a right circular cylindrical outer surface 11 of predetermined diameter 2 R and predetermined circumference. As seen in FIG. 1, oil filter 10 is assembled with an engine block 12 and projects a predetermined axial length L therefrom in known fashion. A standard measure for diameter 2 R is about 2.94 inches (7.47 cm) and for L is about 4.75 inches (12.1 cm). However, diameter 2 R and length L can vary widely.

As is well known, oil filters attain very high temperatures when their associated engines are operated. It is also well known that oil filter performance would be enhanced if their operating temperatures were reduced. The invention enables that result to be achieved. To that end, FIGS. 1 and 2 also show a heat dissipating device 14 removably assembled with filter 10 in surrounding relationship therewith.

Heat dissipating device 14 includes a plurality of like heat dissipating elements 16 of thermally conductive material such as aluminum, and a plurality (three as shown) of metallic coil springs 18. Elements 16 provide three sets of circumferentially aligned holes 20. One coil spring 18 passes through each of the three sets of circumferentially aligned holes 20, and the ends of each spring 18 are joined to each other in known fashion.

As shown in FIGS. 1 and 2, heat dissipating device 14 includes about twenty heat dissipating elements 16. As seen in FIGS. 1, 2 and 3, each element 16 has substantially the shape of an I-beam, with inner and outer flanges 22 and 24, respectively, joined by a central portion 26 which is integral with inner flange 22 centrally thereof and with outer flange 24 centrally thereof. Inner flange 22 provides element 16 with an inner face 28 that is concavely arcuate and of diameter 2 R, for conforming fit against the exterior of oil filter 10. Outer flange 24 provides element 16 with an outer face 30, which preferably contains a longitudinal groove 32 centrally located with respect to outer flange 24.

Elements 16 have the same shape at every longitudinal location and may be formed by extrusion, with holes 20 being formed following extrusion.

Heat dissipating device 14 can be simply and almost instantaneously slipped on oil filter 10 by merely spreading elements 16 slightly at either end of device 14 and pushing it onto filter 10. Device 14 can be removed from filter 10 by simply pulling device 14 off of filter 10. Device 14 is reusable.

The total circumferential extent of inner faces 28 of all heat dissipating elements 16 is less than the circumference of oil filter 10, and springs 18 must be under contracting tension when device 14 is assembled with oil filter 10, to hold inner faces 28 relatively tightly against the cylindrical exterior of oil filter 10.

Heat dissipating device 14 substantially increases the effective area of surface 11 of filter 10, thus providing a substantial improvement in dissipation of heat from filter 10. The area increase is brought about by the shape of elements 16, including inner and outer flanges 22 and 24, respectively, central portion 26, groove 32 and the fact that inner faces 28 relatively tightly engage the cylindrical exterior of oil filter 10. In fact, even springs 18 contribute to the effective area increase.

FIG. 4 is a perspective view of a modified heat dissipating element 34 of a second form. Element 34 differs from element 16 only in that element 34 is provided with laterally projecting lugs 36 at the four outer corners of inner flange 22.

FIG. 5 shows a pair of elements 34 with confronting lugs 36 abutting each other. This, of course, is not the situation when a heat dissipating device including elements 34 is installed. Lugs 36 may improve the performance of the heat dissipating device by minimizing engagement of adjacent heat dissipating elements with each other, by limiting such possible engagement to the corners of the elements. Element 34 can not be extruded in final form, because its transverse shape is not everywhere the same. However, element 34 can be formed by extrusion followed by a machining operation to create lugs 36.

FIG. 6 illustrates in fragmentary plan view a pair of heat dissipating elements 34 with coil springs 18 holding elements 34 in assembled relationship, and with two lugs 36 of each illustrated element 34 engaging two lugs 36 of the other illustrated element 34.

FIG. 7 is an end view of a heat dissipating element 38 of a third form. Element 38 differs from element 16 in that element 38 has substantially the shape of a T-bar. That is, element 38 omits outer flange 24, outer face 30 and groove 32. Thus, element 38 has an outer face 40 that is simply the outer extremity of central portion 26. Element 38 thus is simpler than element 16, but, like element 16, element 38 can be extruded. Element 38 will not increase the effective area of surface 11 of filter 10 to the same extent as will element 16. Thus, element 38 will not be as efficient in operation as will element 16. However, a heat dissipating device incorporating elements 38 will be cheaper than one with elements 16 or elements 34.

It is noted that some heat dissipating effect could be obtained with a single heat dissipating element held against an object.

A heat dissipating device embodying the invention can incorporate therein any of the heat dissipation elements disclosed herein.

If desired, the ends of each spring 18 may be releasably joinable to each other, whereby device 14 can be installed on a cylindrical surface by wrapping it around such surface and then joining the ends of each spring 18 to each other. This is a useful technique where device 14 cannot be slipped over the end of the cylindrical surface.

It is apparent that the invention attains the stated objects and advantages and others.

The disclosed details are exemplary and are not to be taken as limitations on the invention except as those details are included in the appended claims.

What is claimed is:

1. A device for dissipating heat from a cylindrical object, said device comprising a heat dissipating element of thermally conductive material and at least a first spring for releasably and resiliently holding said first heat dissipating element against the exterior of the object, wherein said element has a hole therethrough and said first spring is a coil spring passing through said hole, said spring having ends which are fastened to each other and wherein said heat dissipating element is elongated and is a first heat dissipating element and said device further comprises additional heat dissipating elements which are the same as said first heat dissipating element, each said additional element having a hole therethrough, said first coil spring passing through said holes through said additional elements, and wherein each said heat dissipating element has an inner flange providing said element with an inner face which is concavely arcuate for fitting against the cylindrical object, and a central portion projecting outwardly from a central location relative to said inner flange, said holes being located in said central portions of said heat dissipating elements.

2. A device according to claim 1 wherein each said heat dissipating element has substantially the shape of a T-bar.

3. A device according to claim 1 wherein each said heat dissipating element further has an outer flange providing said element with an outer face, and said central portion project inwardly from a central location relative to said outer flange.

4. A device according to claim 3 wherein each said heat dissipating element has substantially the shape of an I-beam.

5. A device according to claim 3 wherein each said heat dissipating element has a longitudinal groove in said outer face.

6. A device according to claim 1 wherein each said heat dissipating element has the same shape at every longitudinal location.

7. A device according to claim 1 wherein each said heat dissipating element has lugs laterally projecting from a plurality of corners of said inner flange.

8. A device according to claim 7 wherein said lugs project laterally from all four corners of said inner flange.

9. A combination including an oil filter having a right circular cylindrical outer surface of predetermined radius and a predetermined circumference, and a device for dissipating heat from said filter, said device comprising an elongated heat dissipating element of thermally conductive material and a first spring releasably and resiliently holding said heat dissipating element against said outer surface, wherein said elongated heat dissipating element is a first heat dissipating element and said device comprises additional heat dissipating elements which are the same as said first heat dissipating element, each said element having a first hole therethrough, said first spring being a coil spring passing through said first holes and having ends fastened to each other, said first coil spring being under resilient tension and surrounding said right circular cylindrical outer surface, each said heat dissipating element having an inner flange providing said element with an inner face of predetermined transverse dimension engaging said right circular cylindrical outer surface, wherein said inner face of each said element is concavely arcuate, having a radius of curvature substantially equal to the radius of curvature of said right circular cylindrical outer surface, and the sum total of the transverse dimensions is less than said circumference of said right circular cylindrical outer surface.

10. A combination according to claim 9 wherein each said heat dissipating element has a second hole therethrough and said heat dissipating device further comprises a second coil spring passing through said second holes and having ends fastened to each other.

* * * * *